US008816913B2

(12) United States Patent
Rhyu et al.

(10) Patent No.: US 8,816,913 B2
(45) Date of Patent: Aug. 26, 2014

(54) MOBILE TERMINAL

(75) Inventors: Hanphil Rhyu, Seoul (KR); Sungjung Rho, Seoul (KR); Sungjoon Hong, Gyeonggi-Do (KR); Yochuol Ho, Gyeonggi-Do (KR); Euntaek Jeoung, Gyeonggi-Do (KR); Ansun Hyun, Seoul (KR)

(73) Assignee: LG Electronics Inc., Seoul (KR)

( * ) Notice: Subject to any disclaimer, the term of this patent is extended or adjusted under 35 U.S.C. 154(b) by 391 days.

(21) Appl. No.: 13/213,244

(22) Filed: Aug. 19, 2011

(65) Prior Publication Data

US 2012/0105286 A1 May 3, 2012

(30) Foreign Application Priority Data

Nov. 1, 2010 (KR) ..... 10-2010-0107862

(51) Int. Cl.
*H01Q 1/24* (2006.01)

(52) U.S. Cl.
USPC ..... 343/702

(58) Field of Classification Search
USPC ..... 343/729, 876, 700 MS, 725, 900, 702; 455/562.1
See application file for complete search history.

(56) References Cited

U.S. PATENT DOCUMENTS

| | | | | |
|---|---|---|---|---|
| 6,392,610 | B1 * | 5/2002 | Braun et al. | 343/876 |
| 6,954,180 | B1 * | 10/2005 | Braun et al. | 343/702 |
| 7,385,557 | B2 * | 6/2008 | Kim | 343/702 |
| 7,482,991 | B2 * | 1/2009 | Boyle | 343/767 |
| 8,463,340 | B2 * | 6/2013 | Lee et al. | 455/575.7 |
| 2004/0137950 | A1 | 7/2004 | Bolin et al. | |
| 2007/0057849 | A1 | 3/2007 | Moon et al. | |

FOREIGN PATENT DOCUMENTS

| | | | |
|---|---|---|---|
| EP | 1538694 | A1 | 6/2005 |
| WO | WO 03/096474 | A1 | 11/2003 |
| WO | WO 2005/038981 | A1 | 4/2005 |
| WO | WO 2010/095803 | A1 | 8/2010 |

* cited by examiner

*Primary Examiner* — Huedung Mancuso
(74) *Attorney, Agent, or Firm* — Birch, Stewart, Kolasch & Birch, LLP

(57) ABSTRACT

An antenna unit and a mobile terminal having the same are provided. the mobile terminal includes a terminal body having a circuit board for processing wireless signals, a first radiator disposed to overlap the circuit board with being spaced apart from the circuit board, a second radiator disposed adjacent to the first radiator, a first feeding connector configured to allow a feeding connection between the first radiator and the circuit board, and a first ground connector configured to allow a ground connection between the circuit board and the second radiator. With this configuration, the antenna unit can satisfy a multiband characteristic even within a space, in which the antenna unit may be interrupted by the circuit board or a display panel inside the terminal body.

13 Claims, 7 Drawing Sheets

MOBILE TERMINAL

CROSS-REFERENCE TO RELATED APPLICATIONS

Pursuant to 35 U.S.C. §119(a), this application claims the benefit of earlier filing date and right of priority to Korean Application No. 10-2010-0107862, filed on Nov. 1, 2010, the contents of which is incorporated by reference herein in its entirety.

BACKGROUND OF THE INVENTION

1. Field of the Invention

This specification relates to a mobile terminal having an antenna capable of transmitting and receiving wireless electromagnetic waves.

2. Description of Related Art

Mobile communication services are evolving with development of mobile communication technologies and consumers' demands on more various services. Initial mobile communications are merely provided by focusing on voice communications. However, various mobile communication services, such as a multimedia service like music or movie, a wireless Internet service allowing use of Internet at ultrahigh speed even during movement and a satellite communication service providing mobile communications beyond borders, have appeared in recent time. In addition, various mobile communication service methods, such as Personal Communication Services (PCS), Wideband Code Division Multiple Access (WCDMA), ultra wideband mobile communication such as Ultra-wideband (UWB) as well as the existing cellular communication service method, are on the rise.

If such various mobile communication services are provided to one mobile communication terminal at various frequency bands, it may increase convenience and efficiency of the services. Accordingly, broadband wireless terminals have widely been used in recent time, and a technology, which will allow an antenna as one of essential elements of a wireless terminal to operate in a broadband, is requested.

Meanwhile, a typical mobile communication terminal has several disadvantages of lowering of antenna radiation efficiency, narrowing of frequency bands and reduction of an antenna gain, due to a size-reduction of the antenna of the mobile communication terminal. However, in spite of such function degradation, the mobile communication terminal is kept required to be reduced in size, multifunctional and highly efficient. Hence, the antenna used in the mobile communication terminal should also be reduced in size and highly efficient.

The antenna for the typical mobile communication terminal as a quarter-wave monopole antenna or a helical antenna protrudes outside the mobile communication terminal, which causes a user's inconvenience in carrying the terminal and a stability-related problem. To address such problems, active researches for an embedded type antenna are in progress.

As antennas are reduced in size and designed as an embedded type, a study on Planar Inverted F Antenna (PIFA) has been actively conducted. The PIFA is widely adapted as an embedded antenna for a portable terminal, by virtue of its simplified processes and planar structure. However, the embedded antenna is merely limited in its size in order to be mounted in a narrow space of the mobile communications terminal. Also, as the antenna is reduced in size, an input impedance has a small resistance and a large capacitive reactance. Here, if the reactance is eliminated by a matching circuit, a narrowband characteristic is exhibited. In addition, the small resistance characteristic may drastically lower a radiation efficiency of the antenna. Furthermore, a thickness of a mobile communication terminal should be concerned in order to mount the antenna therein, which results in limitation in a height of an antenna in the PIFA structure. Hence, the embedded antenna has limitations in obtaining wide bandwidths.

As such, there are physical limitations in making a small and light antenna, which is used in a portable terminal, have a ultra wideband, due to the limitation in the size of a portable terminal.

BRIEF SUMMARY OF THE INVENTION

Therefore, to address those drawbacks of the related art, an aspect of the detailed description is to provide a mobile terminal having an antenna unit with an improved function.

To achieve this and other advantages and in accordance with the purpose of this specification, as embodied and broadly described herein, a mobile terminal including a terminal body having a circuit board for processing wireless signals, a first radiator disposed to overlap the circuit board with being spaced apart from the circuit board, a second radiator disposed adjacent to the first radiator, a first feeding connector configured to allow a feeding connection between the first radiator and the circuit board, and a first ground connector configured to allow a ground connection between the circuit board and the second radiator.

In accordance with one example, the first feeding connector and the first ground connector may be electrically connected to each other by an inductor.

In accordance with another exemplary embodiment, a mobile terminal may include a display region disposed on one surface of a terminal body to display visual information, a display panel disposed adjacent to an end of the terminal body such that the display region can extend up to the end of the terminal body, and an antenna unit overlapping the display region and formed to reduce a spaced distance from the display panel, wherein the antenna unit includes a first radiator having a feeding connection with a circuit board, and a second radiator disposed adjacent to the first radiator to be coupled thereto, and having a ground connection with the circuit board.

In accordance with another exemplary embodiment, a mobile terminal may include an antenna unit configured to radiate wireless signals, and a terminal body having an electrical ground, wherein the antenna unit includes a first radiator and a second radiator disposed adjacent to each other to be coupled to each other, a first feeding connector configured to feed the first radiator, and a first ground connector configured to allow a ground connection between the electrical ground and the second radiator.

As such, in the mobile terminal in accordance with at least one exemplary embodiment, two radiators can be disposed adjacent to each other, which allows an antenna to satisfy a multiband characteristic even within a space, in which the antenna unit may be interrupted by the circuit board or a display panel inside the terminal body.

Consequently, economical efficiency can be ensured by virtue of reduction of size and the number of components of the terminal.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention. In the drawings.

DETAILED DESCRIPTION OF THE INVENTION

Figure 1:
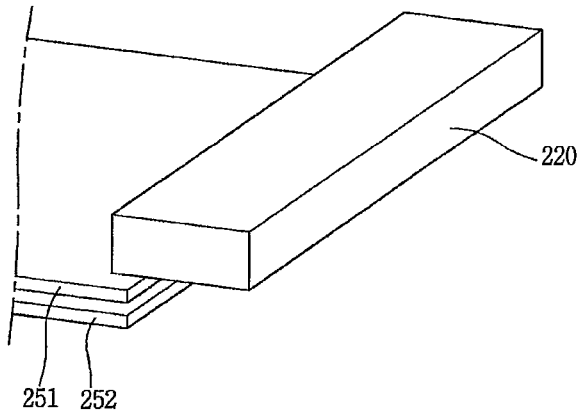
FIG. 1 is an overview showing an example of an antenna for a mobile terminal according to this specification.

Description will now be given in detail of a mobile terminal according to the exemplary embodiments, with reference to the accompanying drawings. This specification employs like/similar reference numerals for like/similar components irrespective of different embodiments, so they all will be understood by the first description. The expression in the singular form in this specification will cover the expression in the plural form unless otherwise indicated obviously from the context.

Figure 2:
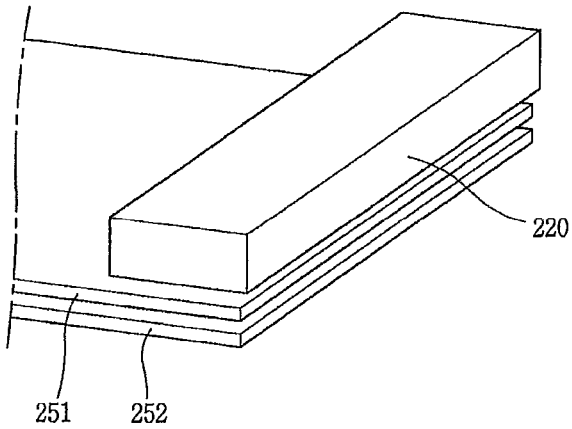
FIG. 2 is an overview showing another example of the antenna for the mobile terminal.
Figure 3:
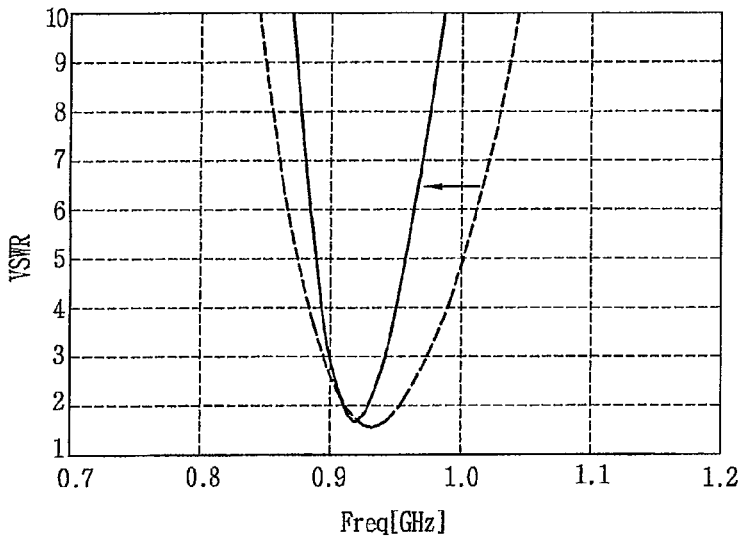
FIG. 3 is a graph of comparing voltage standing-wave ratios according to frequencies in case of using the antennas shown in FIGS. 1 and 2.

FIG. 1 is an overview showing an example of an antenna for a mobile terminal according to this specification, FIG. 2 is an overview showing another example of the antenna for the mobile terminal, and FIG. 3 is a graph of comparing voltage standing-wave ratios (VSWRs) according to frequencies in case of using the antennas shown in FIGS. 1 and 2.

As shown in FIG. 1, an antenna 220 for a terminal is typically arranged not to overlap a circuit board 251 having metal elements or a display panel 252. As shown in FIG. 2, when the antenna 220 of the terminal overlaps the circuit board 251 or the display panel 252, a bandwidth of the antenna 220 may be decreased in a specific mobile communication band or a plurality of mobile communication bands or a radiation efficiency of the antenna 220 may be lowered. To solve those problems, the antenna 220 may be disposed by being spaced apart from one surface of the circuit board 251 or the display panel 252. However, this solution does not afford satisfaction due to an increase in the size (volume) of the terminal.

Figure 4:
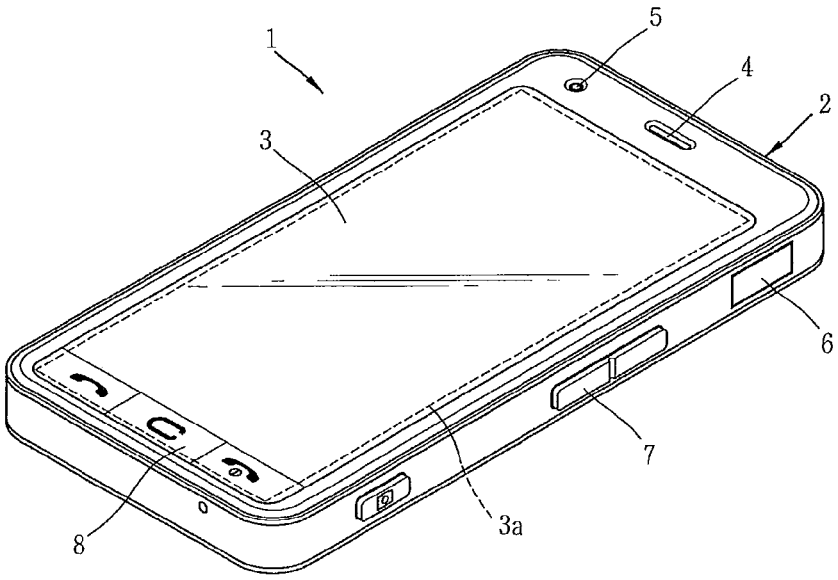
FIG. 4 is a perspective view showing an example of a mobile terminal having an antenna according to this specification.
Figure 5:
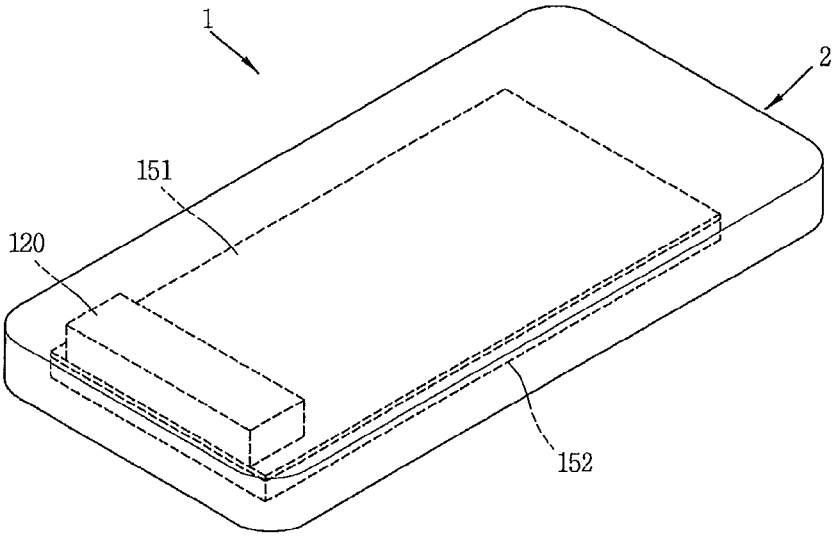
FIG. 5 is a rear perspective view of the mobile terminal shown in FIG. 4.

FIG. 4 is a perspective view showing an example of a mobile terminal having an antenna according to this specification, and FIG. 5 is a projected view of the antenna mounted in the mobile terminal of FIG. 4.

As shown in FIG. 4, the mobile terminal 1 disclosed herein is provided with a bar-type terminal body 2. However, the present application is not limited to this type of terminal, but is also applicable to various structures of terminals, such as a folder type having two terminals bodies foldably coupled to each other, a slid type having two terminal bodies slidably coupled to each other, or the like, or a mobile terminal having a form factor.

The front surface of the terminal body 2 is shown having a display unit 3, an audio output unit 4, an image input unit 5, an audio input unit and the like.

A first manipulation unit 8 may receive a command input for controlling operations of the mobile terminal 1. As another example, the first manipulation unit 8 may be omitted, and the function of the first manipulation unit 8 may be carried out by the display unit 3.

The display unit 3 may display visual information, and include a liquid crystal display (LCD) module, an organic light-emitting diode (OLED) module, an e-paper, a transparent OLED (TOLED) module and the like. Also, the display unit 3 may include a touch detecting element so as to receive information or control command by a user's touch input. The touch detecting element may include a transparent electrode film disposed within a window.

The audio output unit 4 may be implemented as a receiver, a loud speaker and the like.

The image input unit 5 may be implemented as a camera module for capturing still images or moving images of a user or other objects.

The audio input unit may be implemented, for example, as a microphone for receiving user's voice, other sounds or the like therethrough.

The display unit 3 and the audio output unit 4 may alternatively be installed on another surface (e.g., a side or rear surface) of the terminal body 2 or further be installed on the same surface of the terminal body 2.

Referring to FIG. 4, a side surface of the mobile terminal 1 is shown having a second manipulation unit 7, an interface unit 6 and the like.

The second manipulation unit 7 and the first manipulation unit 8 may be referred to as a manipulating portion. Any method may be employed if it is implemented in a tactile manner allowing the user to perform manipulation with a tactile feeling. For example, the manipulating portion may be implemented as a dome switch, a touch screen or a touchpad for allowing an input of command or information by a user's touching or pushing operation, or a jog wheel or a joystick for rotating a key. In the aspect of functions, the first manipulation unit 8 may be configured to input information such as numbers, letters or symbols, or menus such as Start, End or the like, and the second manipulation unit 7 may operate as a hot-key for performing a specific function, such as activating the image input unit 5, as well as a scroll function.

The interface unit 6 may serve as a path for data exchange or the like with an external device. For example, the interface unit 6 may be at least one of wired/wireless earset connection terminals, ports for short-range communication (e.g., Infrared (IrDA) port, Bluetooth™ port, a wireless LAN (WLAN) port and the like), power supply terminals for supplying power to the mobile terminal 1 and the like. The interface unit 6 may be a card socket for accommodating external cards, such as a subscriber identification module (SIM) or a user identity module (UIM), a memory card for storage of information and the like.

Still referring to FIG. 4, the terminal according to the one exemplary embodiment may include a display region 3*a* extending to an end portion of the terminal body 2 for displaying visual information. This structure may provide a wider screen within a limited space.

As shown in FIG. 5, in accordance with the one exemplary embodiment, an antenna 120 may be disposed within the terminal body 2 to overlap a circuit board 151 or a display panel 152. As one example, the display panel 152, as aforesaid, may be a component of an LCD module configuring the display unit 3. A sub antenna (not shown) may be separately installed with being spaced apart from the antenna 120. Accordingly, the mobile terminal 1 allowed for transmission and reception with respect to multiple frequencies can be implemented.

For multiple frequency bands, for example, regarding first and second frequency bands, one of the first and second frequency bands may be higher than the other.

For example, the first frequency band may be a frequency band related to Bluetooth, Global Positioning System (GPS), Wi-Fi and the like, and transmitted and received via a PIFA antenna. The second frequency band may be a frequency band for a call placed by a portable terminal.

Hereinafter, description will be given in detail of the antenna 120 having excellent wireless frequency efficiency even when the antenna 120 is disposed to overlap the circuit board 151 or the display panel 152, with reference to the accompanying drawings.

Figure 6:
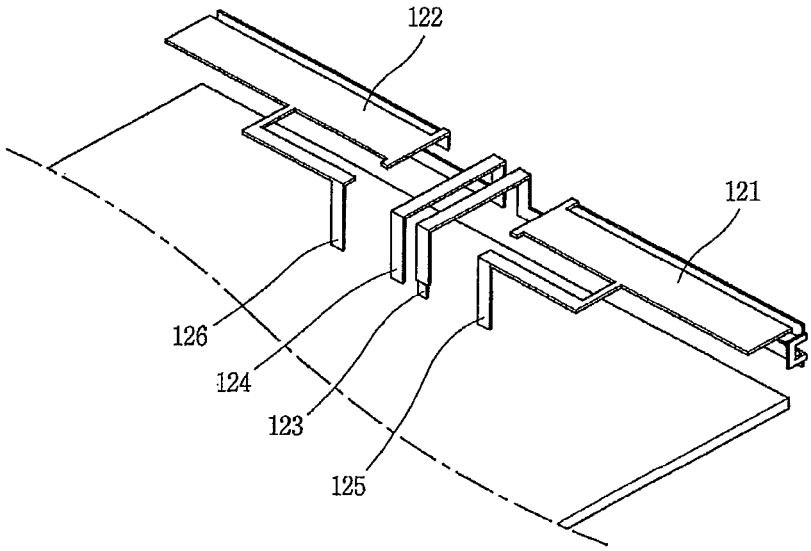
FIG. 6 is a perspective view showing a detailed example of an antenna viewed in one direction.
Figure 7:
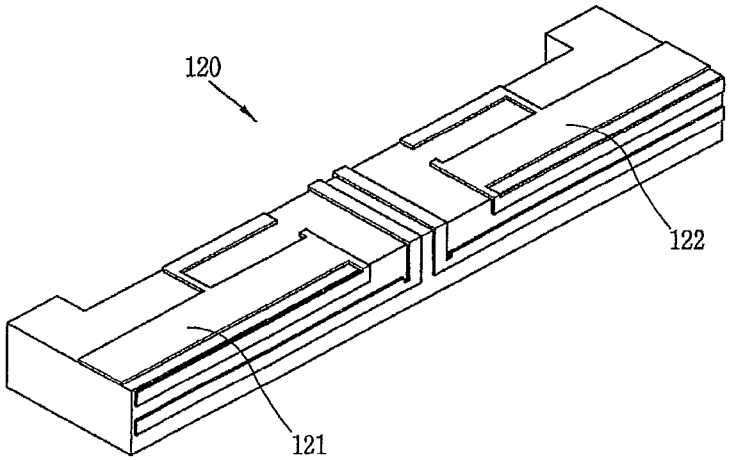
FIG. 7 is a perspective view of an exemplary antenna, which shows a state that the antenna is coupled to a carrier.
Figure 8:
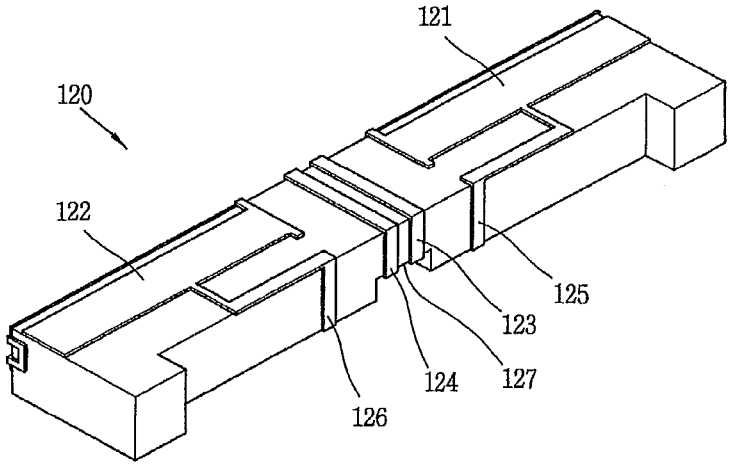
FIG. 8 is a perspective view showing the antenna of FIG. 7 viewed in an opposite direction.

FIG. 6 is a perspective view showing a detailed example of the antenna viewed in one direction, FIG. 7 is a perspective view of the antenna, which shows a state that the antenna is coupled to a carrier, and FIG. 8 is a perspective view showing the antenna of FIG. 7 viewed in an opposite direction.

As shown in FIGS. 6 to 8, the antenna 120 may include a first radiator 121, and a second radiator 122 disposed adjacent to the first radiator 121. The first and second radiators 121 and 122 may be coupled to a carrier.

The first radiator 121 and the second radiator 122 may be implemented as conductive patterns, which operate at one of a Code Division Multiple Access (CDMA) and Global System for Mobile communication (GSM) communication band (800~1000 MHz), a Personal Communication System (PCS) and Digital Cellular System (DCS) communication band (1700~1900 MHz) or a Wideband CDMA (WCDMA) communication band (2.4 GHz), each of which ensures sufficient band characteristics. An operating frequency band is decided by electrical lengths of the first and second radiators 121 and 122. The first and second radiators 121 and 122 may generate a coupling effect so as to generate a capacitive capacitance component, which regulates a bandwidth characteristic.

In a state that the first and second radiators 121 and 122 are adjacent to each other, the first and second radiators 121 and 122 are electrically fed by an electrical connection (or an Electromagenetic (EM) feeding) between a first feeding connector 123 and the first radiator 121. One end of the second radiator 122 is connected to a first ground connector 124 to be electrically shorted, thereby implementing an antenna resonant frequency and an impedance matching.

Each of the first and second radiators 121 and 122 may have conductors with a winding shape (e.g., zigzag), for example. The conductor may be fabricated in various shapes according to resonance or frequency characteristics. A current is fed to the conductors via the feeding connectors, and the fed current is shorted by the ground connectors.

The feeding connectors may be configured to electrically connect a feeding system (not shown) to the first and second radiators 121 and 122. For the connection, the feeding connector may include a feeding plate, a feeding clip and a feeding wire. Here, the feeding plate, the feeding clip and the feeding wire may be electrically connected all together, and make a current (or voltage) supplied via the feeding system to the conductors of the radiators 121 and 122. Here, the feeding wire may include a microstrip printed on a board.

The ground connectors may electrically connect an electrical ground to one ends of the first and second radiators 121 and 122, respectively, thereby grounding the first and second radiators 121 and 122. Here, the ground connector may include at least two paths having different lengths, and switches corresponding to the respective paths. The paths may allow the electrical ground to be selectively connected to the first and second radiators 121 and 122 by the switches for selecting the paths, so as to have different lengths. Here, the path may serve as an electrical path for connection between a ground and a radiator, and include a ground plate, a ground clip and a group wire. The ground wires of the paths may have different lengths to thereby vary the lengths of the paths.

The first feeding connector 123 and a first ground connector 124 may be electrically connected to each other by an inductor 127. The inductor 127 may minutely regulate each path defined from the first feeding connector 123 to the first ground connector 124 via the respective first and second radiators 121 and 122, which allows tuning for transmitting and receiving designed frequency bands more efficiently.

Figure 9:
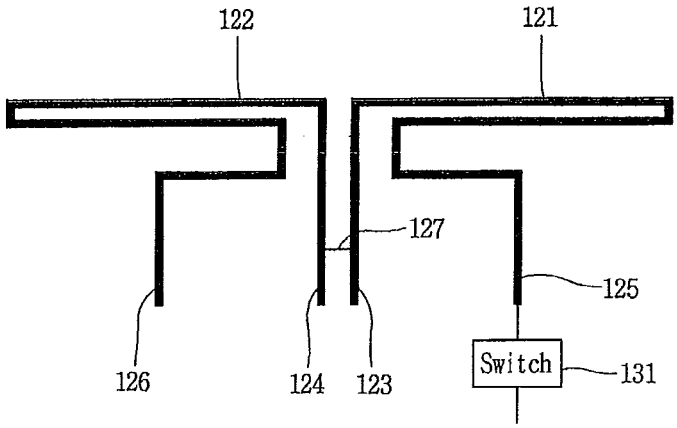
FIG. 9 is an overview of an antenna in accordance with one exemplary embodiment.
Figure 10:
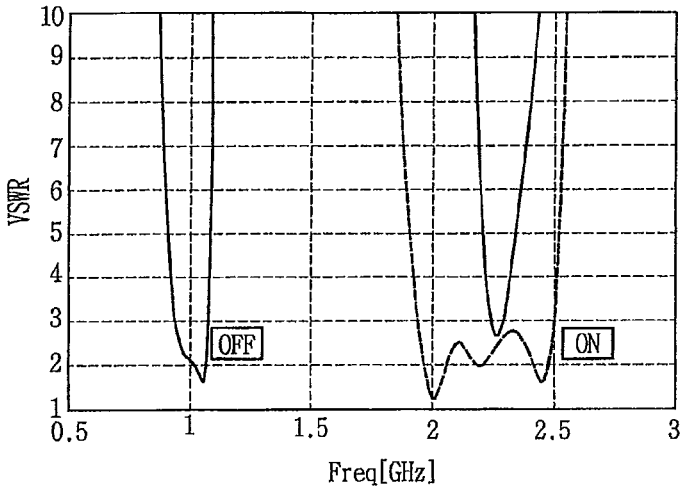
FIG. 10 is a graph of comparing voltage standing-wave ratios according to frequencies in a switch-on state and a switch-off state of the antenna according to the one exemplary embodiment.

FIG. 9 is an overview of an antenna in accordance with one exemplary embodiment, and FIG. 10 is a graph showing comparison results of voltage standing-wave ratios (VSWR) according to frequencies in an On-state and an Off-state of a first switch of the antenna according to the one exemplary embodiment.

As shown in FIG. 9, one end of the first radiator 121 is shown having the first feeding connector 123 and the second ground connector 125, and one end of the second radiator 122 is shown having the first ground connector 124 and the second feeding connector 126.

In this exemplary embodiment, the second feeding connector 126 is in an open state, namely, grounding or feeding is not carried out at the second feeding connector 126. However, the second ground connector 125 may include a first switch 131, and thus carry out an electrical short by turning on or off the first switch 131. Also, in order for the first and second radiators 121 and 122 to have frequency bands similar to each other, each path, which is defined from the first feeding connector 123 to the first ground connector 124 via the respective first and second radiators 121 and 122, may be formed with a length of a quarter-wavelength ($\lambda/4$) or half-wavelength ($\lambda/2$) of a specific frequency.

Referring to FIGS. 9 and 10, the second radiator 122 radiates a specific frequency band (EGSM) irrespective of turning on or off the first switch 131. In addition, when the first switch 131 is turned off, the second ground connector 125 is open, so the first radiator 121 radiates a specific frequency band (GSM). Here, the first and second radiators 121 and 122 are electrically fed in a coupled state. As shown in FIG. 10, the VSWRs at the frequency bands (EGSM AND GSM) are less than 3, from which it can be understood that the broadband efficiency of a wireless frequency has been improved.

In the meantime, an electrical short is carried out by the second ground connector 125 in an ON-state of the first switch 131. Accordingly, the first radiator 121 forms a loop structure that one side is electrically fed and the other side is grounded. The first radiator 121 thus resonates with the half-wavelength (λ/2) corresponding to each specific frequency band (DCS, PCS, WCDMA, etc.) and has a broadband frequency characteristic. Even in this case, referring to FIG. 10, the VSWRs at the frequency bands are less than 3. Thus, it can be noticed that an excellent broadband performance (efficiency) of a wireless frequency has been ensured.

Also, the switch of the exemplary embodiment may be implemented as SPST, PIN Diode, SPDP, MEMS and the like.

Thus, in accordance with the one embodiment, even when an antenna is disposed to overlap the circuit board 151 or the display panel 152, a good bandwidth can be acquired without an increase in a thickness of the terminal due to arranging the antenna with a spaced distance.

Figure 11:
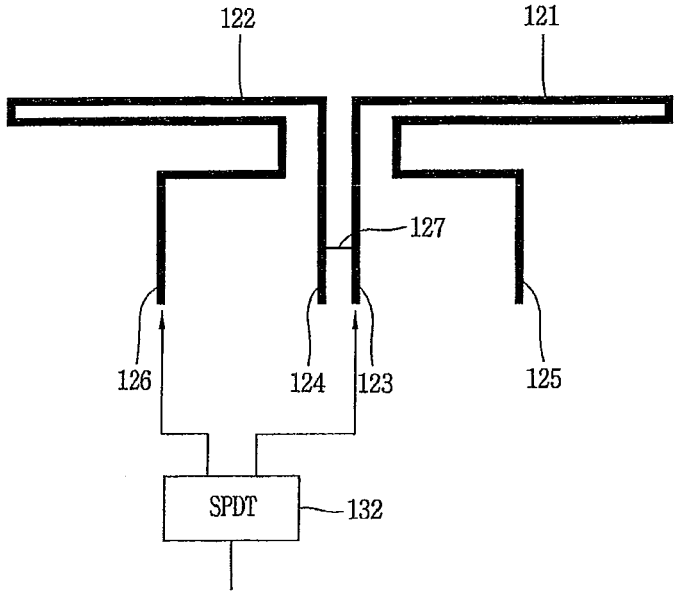
FIG. 11 is an overview of an antenna in accordance with another exemplary embodiment.

FIG. 11 is an overview of an antenna in accordance with another exemplary embodiment. As shown in FIG. 11, the first feeding connector 123 and the second feeding connector 126 are connected via a second switch 132 to allow switching for feeding with respect to the first and second radiators 121 and 122. As one example, if the first radiator 121 resonates with a quarter-wavelength to faun a specific frequency band (GSM) and switching is carried out to electrically feed the first radiator 121, the same result as described above can be obtained.

On the contrary, when switching is carried out to electrically feed the second radiator 122, the first feeding connector 123 is open, and thus one end of the second radiator 122 serves as a feeding connector or a ground connector. Accordingly, a resonation of a half-wavelength (λ/2) corresponding to a specific frequency (DCS, PCS, WCDMA) is generated.

Figure 12:
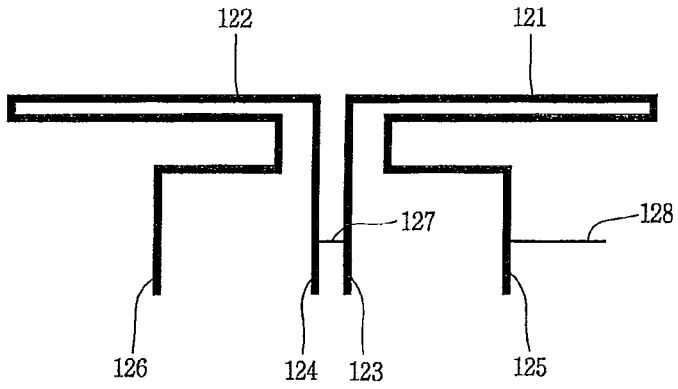
FIG. 12 is an overview of an antenna in accordance with another exemplary embodiment.

FIG. 12 is an overview of an antenna in accordance with another exemplary embodiment. As shown in FIG. 12, for a bandwidth expansion and impedance matching upon carrying out a high frequency band operation, a sub radiator 128 extending from one end of the first radiator 121 or the second radiator 122 as a main radiator may further be disposed.

Figure 13:
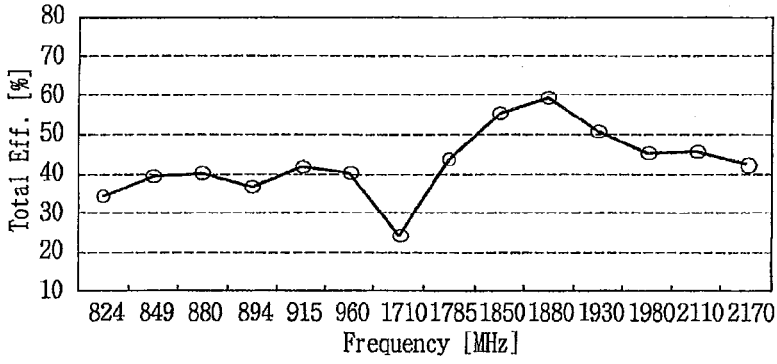
FIG. 13 is a graph showing radiation efficiencies according to frequencies in the antenna according to the one exemplary embodiment.

FIG. 13 is a graph showing comparison results of radiation efficiencies according to frequencies of the antenna according to the one exemplary embodiment. As shown in the graph, it can be noticed that a satisfactory radiation efficiency is exhibited at a Code Division Multiple Access (CDMA) and Global System for Mobile communication (GSM) communication band (800~1000 MHz), a Personal Communication System (PCS) and Digital Cellular System (DCS) communication band (1700~1900 MHz) and a Wideband CDMA (WCDMA) communication band (2.4 GHz). Consequently, the antenna 120 according to the one exemplary embodiment can satisfy a multiband characteristic even within a space, in which the radiation efficiency of the antenna is interrupted due to the circuit board 151 or the display panel 152 within the terminal body.

The foregoing embodiments and advantages of the constructions and methods are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A mobile terminal comprising:

a terminal body;

a circuit board located in the terminal body, the circuit board being configured to process wireless signals;

a first radiator disposed to overlap the circuit board, the first radiator being spaced from the circuit board;

a second radiator disposed adjacent to the first radiator;

a first feeding connector configured to allow a feeding connection between the first radiator and the circuit board;

a first ground connector configured to allow a ground connection between the circuit board and the second radiator; and a second feeding connector configured to allow a feeding connection between the second radiator and the circuit board, wherein the second radiator is fed by a capacitive coupling when the first radiator is fed by the first feeding connector, wherein the first and second radiators resonate in similar frequency bands, and wherein the first feeding connector and the second feeding connector are connected to the circuit board by a second switch, the second switch configured to switch on or off an electrical flow to the first feeding connector and the second feeding connector.

2. The terminal of claim 1, wherein the first feeding connector and the first ground connector are electrically connected to each other by an inductor.

3. The terminal of claim 1, further comprising a second ground connector configured to allow a ground connection between the circuit board and the first radiator.

4. The terminal of claim 3, wherein the second ground connector includes a first switch configured to switch on or off the ground connection between the circuit board and the first radiator.

5. The terminal of claim 1, further comprising a sub radiator extending from one end of the first radiator or second radiator.

6. The terminal of claim 1, wherein each path defined from the first feeding connector to the first ground connector via the respective first and second radiators has a length of a half-wavelength or quarter-wavelength to correspond to a specific frequency of wireless electromagnetic wave.

7. The terminal of claim 6, further comprising an antenna embedded in the terminal body, the antenna being configured to transmit and receive wireless electromagnetic waves of a frequency band different from the wireless electromagnetic waves of said specific frequency.

8. The terminal of claim 1, wherein the first radiator and the second radiator are coupled to each other by one carrier.

9. The terminal of claim 1, further comprising a coupling disposed adjacent the second radiator, the coupling providing a connection between the first and second radiators such that the second radiator is configured to radiate by being electrically fed via the coupling and the first radiator.

10. A mobile terminal comprising:

a terminal body, the terminal body including a display region disposed on one surface of the terminal body to display visual information;

a display panel disposed adjacent to an end of the terminal body such that the display region extends to the end of the terminal body;

a circuit board located in the terminal body; and an antenna unit disposed to overlap the display region, the antenna unit being spaced from the display panel, the antenna unit including:

a first radiator having a feeding connection with the circuit board; and a second radiator disposed adjacent to the first radiator to be coupled thereto, the second radiator having a ground connection with the circuit board, wherein the first radiator includes a first feeding connector to define a feeding path, wherein the second radiator includes a first ground connector to define a first ground path, and a second feeding connector, wherein the second radiator is fed by a capacitive coupling when the first radiator is fed by the first feeding connector, wherein the first and second radiators resonate in similar frequency bands, and wherein the first feeding connector and the second feeding connector are connected to the circuit board via a second switch to selectively feed the first radiator or the second radiator, and the second switch is configured to switch on or off an electrical flow to the first feeding connector and the second feeding connector.

11. The terminal of claim 10, wherein the first feeding connector and the first ground connector are located adjacent to each other and are electrically connected to each other by an inductor.

12. The terminal of claim 10, wherein the first radiator includes a second ground connector to define a second ground path, the second ground connector including a switch configured to switch on or off a ground connection between the circuit board and the first radiator.

13. The terminal of claim 10, further comprising a sub radiator extending from one end of the first radiator or the second radiator.

* * * * *